US007017947B1

(12) United States Patent
Diggle, III

(10) Patent No.: US 7,017,947 B1
(45) Date of Patent: Mar. 28, 2006

(54) PIPE HOLDER

(75) Inventor: Frederick James Diggle, III, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/695,573

(22) Filed: Oct. 28, 2003

(51) Int. Cl.
*B05B 15/06* (2006.01)

(52) U.S. Cl. ..... 285/61; 285/24; 248/77; 248/72; 182/10; 182/51

(58) Field of Classification Search ..... 285/24, 285/61, 64; 248/76, 77, 78, 73, 74.1; 182/51, 182/52, 10
See application file for complete search history.

(56) References Cited

U.S. PATENT DOCUMENTS 630,563 A * 8/1899 Robinson ..... 248/76
1,373,716 A * 4/1921 Dottl et al. ..... 248/74.1
1,470,642 A * 10/1923 Ready ..... 248/74.1
1,583,772 A * 5/1926 Blaw ..... 248/77
1,790,610 A * 1/1931 Vindal ..... 285/64
2,227,779 A * 1/1941 Grant ..... 285/61
2,692,719 A * 10/1954 Maloney ..... 248/77
2,904,293 A * 9/1959 Thompson ..... 248/74.1
3,185,418 A * 5/1965 Appleton ..... 248/74.1
3,301,513 A * 1/1967 Sugaya ..... 248/72
4,327,887 A * 5/1982 Kumakura ..... 248/73
4,666,116 A * 5/1987 Lloyd ..... 248/72

OTHER PUBLICATIONS

U.S. Appl. No. 10/718,460 filed Nov. 20, 2003.
U.S. Appl. No. filed Dec. 4, 2003. Express Mail Label No. EU990163769US.

* cited by examiner

*Primary Examiner*—David Bochna
(74) *Attorney, Agent, or Firm*—Lee & Hayes PLLC

(57) ABSTRACT

A pipe holder includes a body member and a support member connected to and extending away from the body member. The body member defines an opening proximate a first end of the body member.

20 Claims, 6 Drawing Sheets

PIPE HOLDER

BACKGROUND

The present application is related, generally and in various embodiments, to a pipe holder. In the telecommunication and other industries, personnel working at certain jobsites are routinely required to cut pipe to various lengths. For example, electricians are often required to cut thin walled conduit to various lengths when provisioning new buildings.

To position the conduit for cutting, some personnel first pass a section of the conduit through a conduit bender, thereby creating a triangle with one end of the conduit pressed against the ground. The personnel then steady the conduit bender against the ground by applying pressure to the conduit bender with their foot. With this procedure, the personnel usually bend over to make the cut just a few inches off of the ground, thereby leading to inaccurate cuts, increased worker fatigue and decreased productivity.

To position the conduit for more comfortable cutting, other personnel first slide the conduit over a step of a ladder, then steady the conduit against the step by applying pressure to the conduit with their foot. With this procedure, the conduit is still susceptible to unwanted movement. Such unwanted movement often results in inaccurate cuts, increased worker fatigue and decreased productivity.

SUMMARY

In one general respect, this application discloses embodiments of a pipe holder. According to various embodiments, the pipe holder includes a body member and a support member connected to and extending away from the body member. The body member defines an opening proximate a first end of the body member.

In another general respect, this application discloses embodiments of a ladder. According to various embodiments, the ladder includes first and second side rails, a crossmember connected to the first and second side rails, and a pipe holder connected to the crossmember. The pipe holder includes a body member and a support member connected to and extending away from the body member. The body member defines an opening proximate a first end of the body member.

Other embodiments of the disclosed invention will be or become apparent to one skilled in the art upon review of the following drawings and detailed description. It is intended that all such additional embodiments be included within this description, be within the scope of the disclosed invention, and be protected by the accompanying claims.

DETAILED DESCRIPTION

Figure 1:
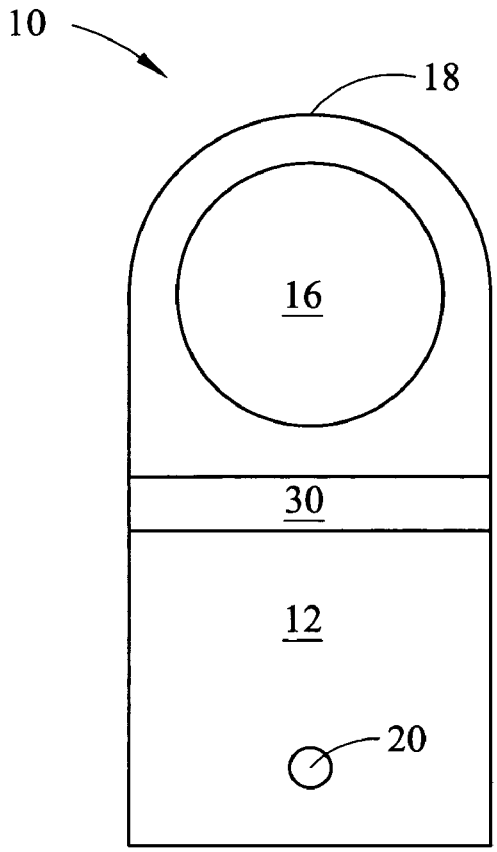
FIG. 1 illustrates a pipe holder according to various embodiments.

FIGS. 1–6 illustrate a pipe holder 10 according to various embodiments. The pipe holder 10 includes a body member 12 and a support member 14. The body member 12 defines an opening 16 positioned proximate a first end 18 of the pipe holder 10. The opening 16 is a circular-shaped opening sized to allow pipe of various diameters to pass therethrough. The support member 14 is connected to the body member 12 and extends away from the body member 12 perpendicular to the body member 12. According to various embodiments, the pipe holder 10 is fabricated from a metal. According to other embodiments, the pipe holder 10 is fabricated from a plastic.

Figure 2:
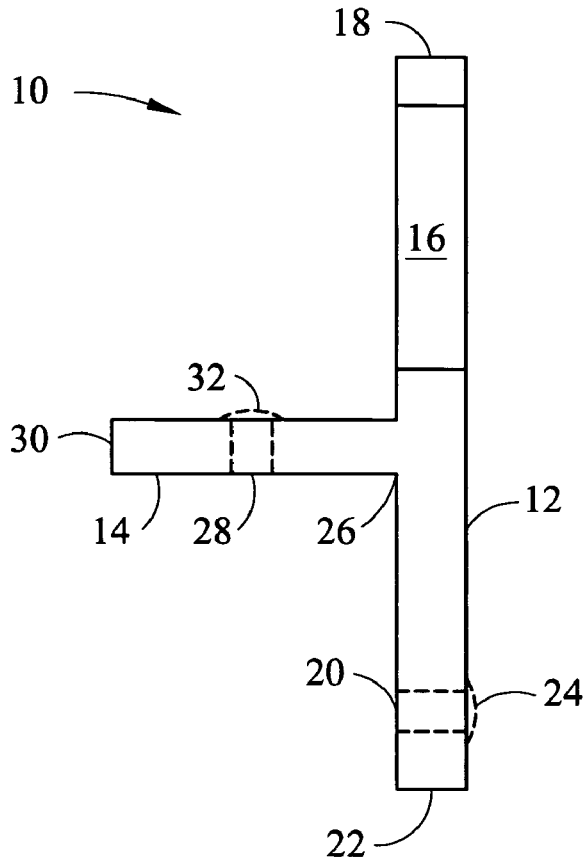
FIG. 2 is a side view of the pipe holder of FIG. 1 according to various embodiments.

As shown in FIGS. 1 and 2, the body member 10 defines a second opening 20 positioned between the support member 14 and a second end 22 of the body member 12. The second opening 20 is a threaded opening configured to threadedly engage a first set screw 24. The support member 14 includes a first end 26 that is connected to the body member 12. The support member 14 defines a third opening 28 positioned between the first end 24 of the support member 14 and a second end 30 of the support member 14. The third opening 28 is a threaded opening configured to threadedly engage a second set screw 32.

Figure 3:
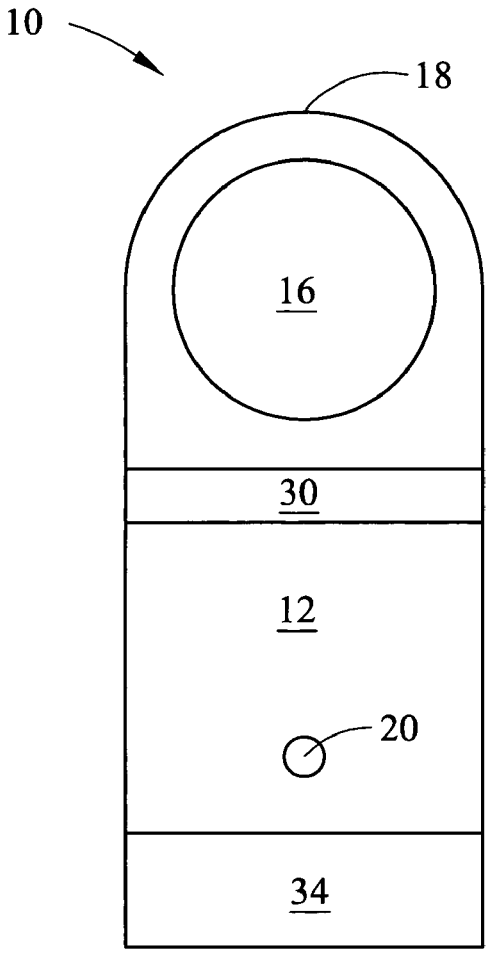
FIG. 3 illustrates a pipe holder according to various embodiments.
Figure 4:
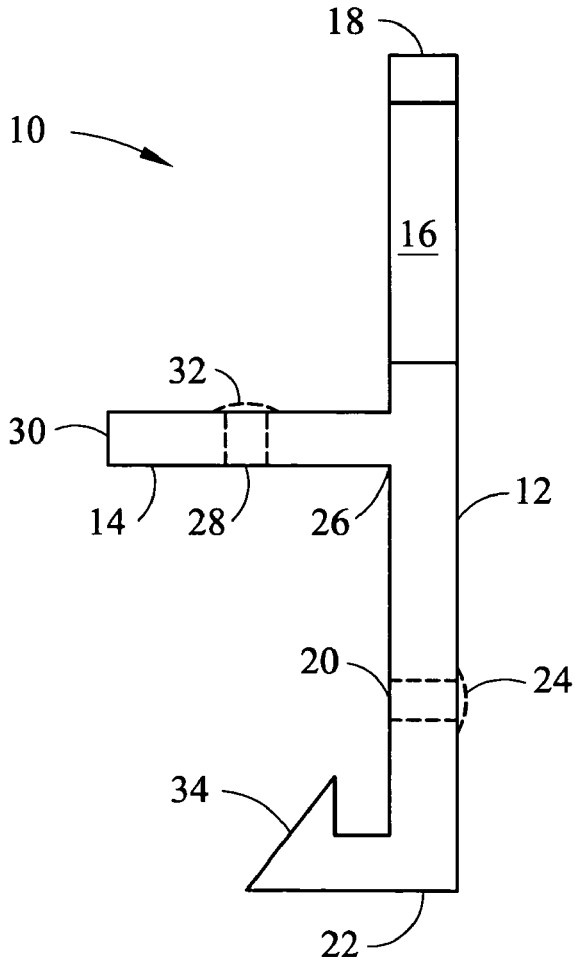
FIG. 4 is a side view of the pipe holder of FIG. 3 according to various embodiments.

As shown in FIGS. 3 and 4, the body member 12 of various embodiments of the pipe holder 10 includes a hook portion 34 at the second end 22 of the body member 12. The hook portion 34 of the body member 12 is elastic such that it returns to its original position after being bent.

Figure 5:
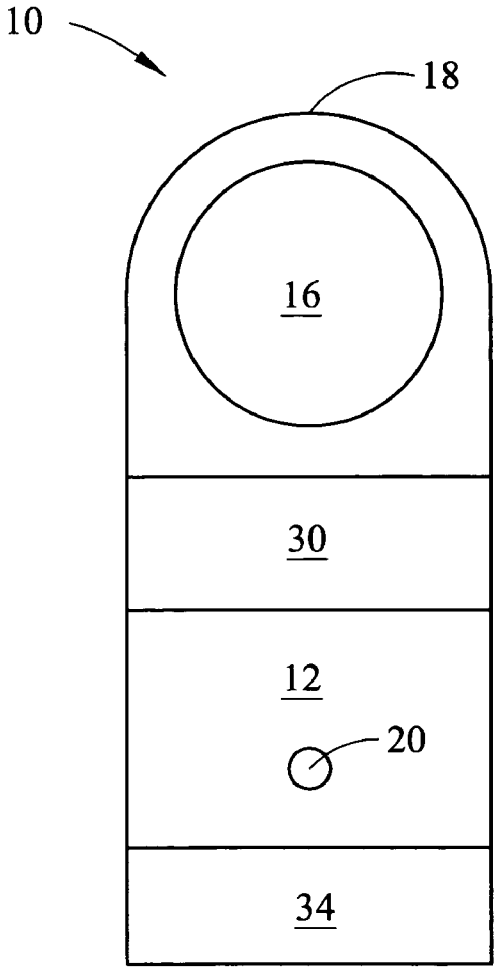
FIG. 5 illustrates a pipe holder according to various embodiments.
Figure 6:
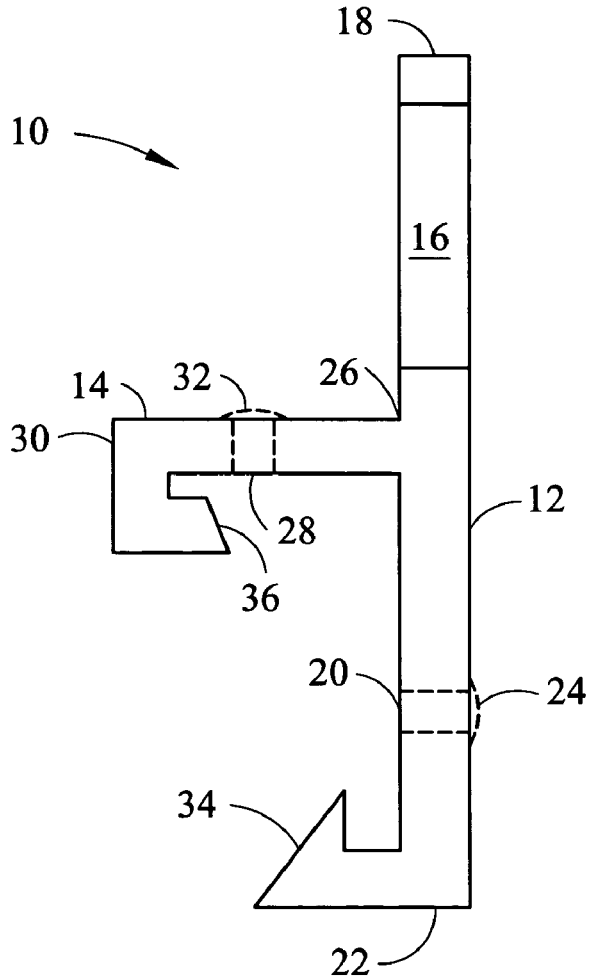
FIG. 6 is a side view of the pipe holder of FIG. 5 according to various embodiments.

As shown in FIGS. 5 and 6, the support member 14 of various embodiments of the pipe holder 10 includes a hook portion 36 at the second end 30 of the support member 12. The hook portion 36 of the support member 12 is elastic such that it returns to its original position after being bent.

Figure 7:
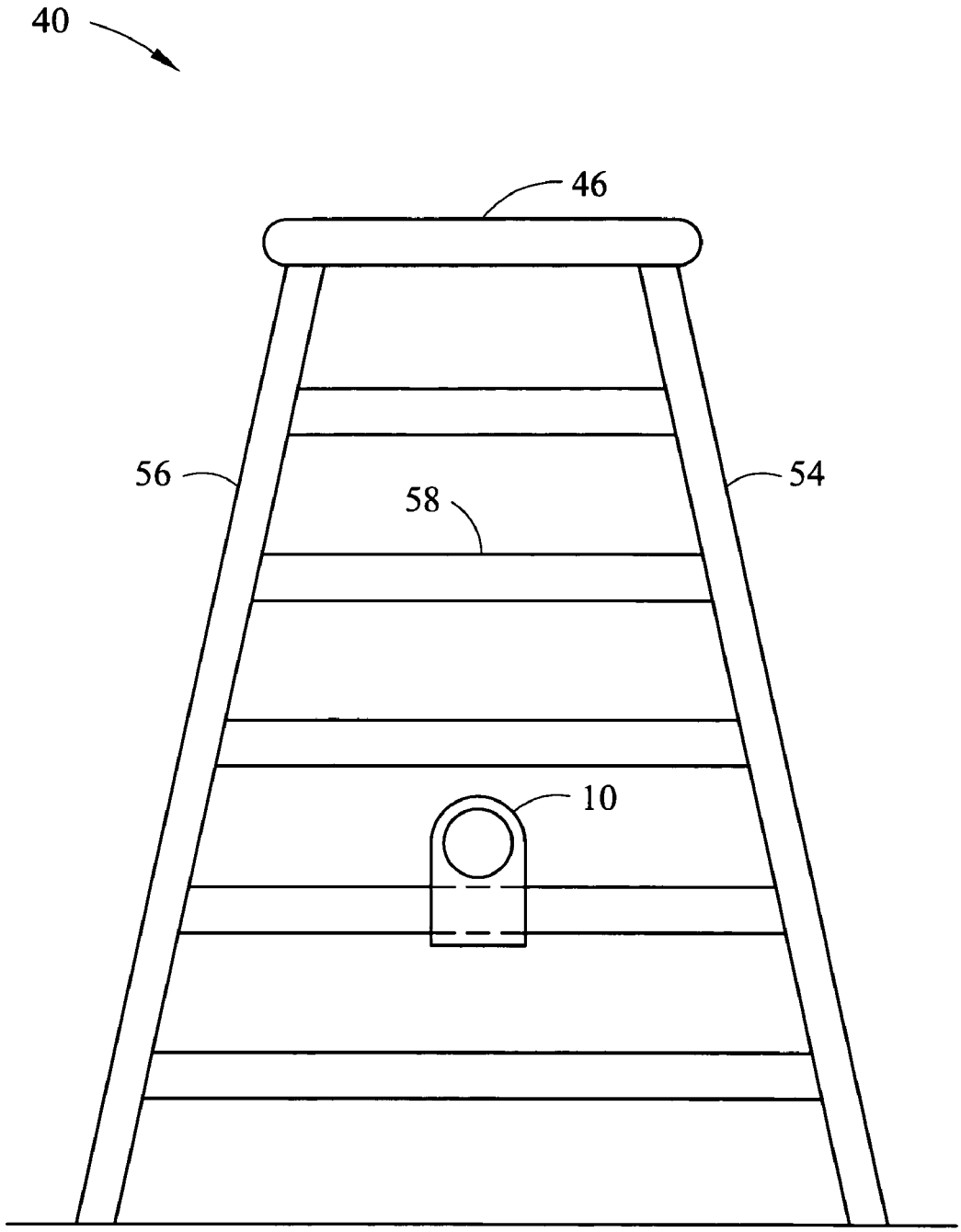
FIG. 7 illustrates a ladder according to various embodiments.
Figure 8:
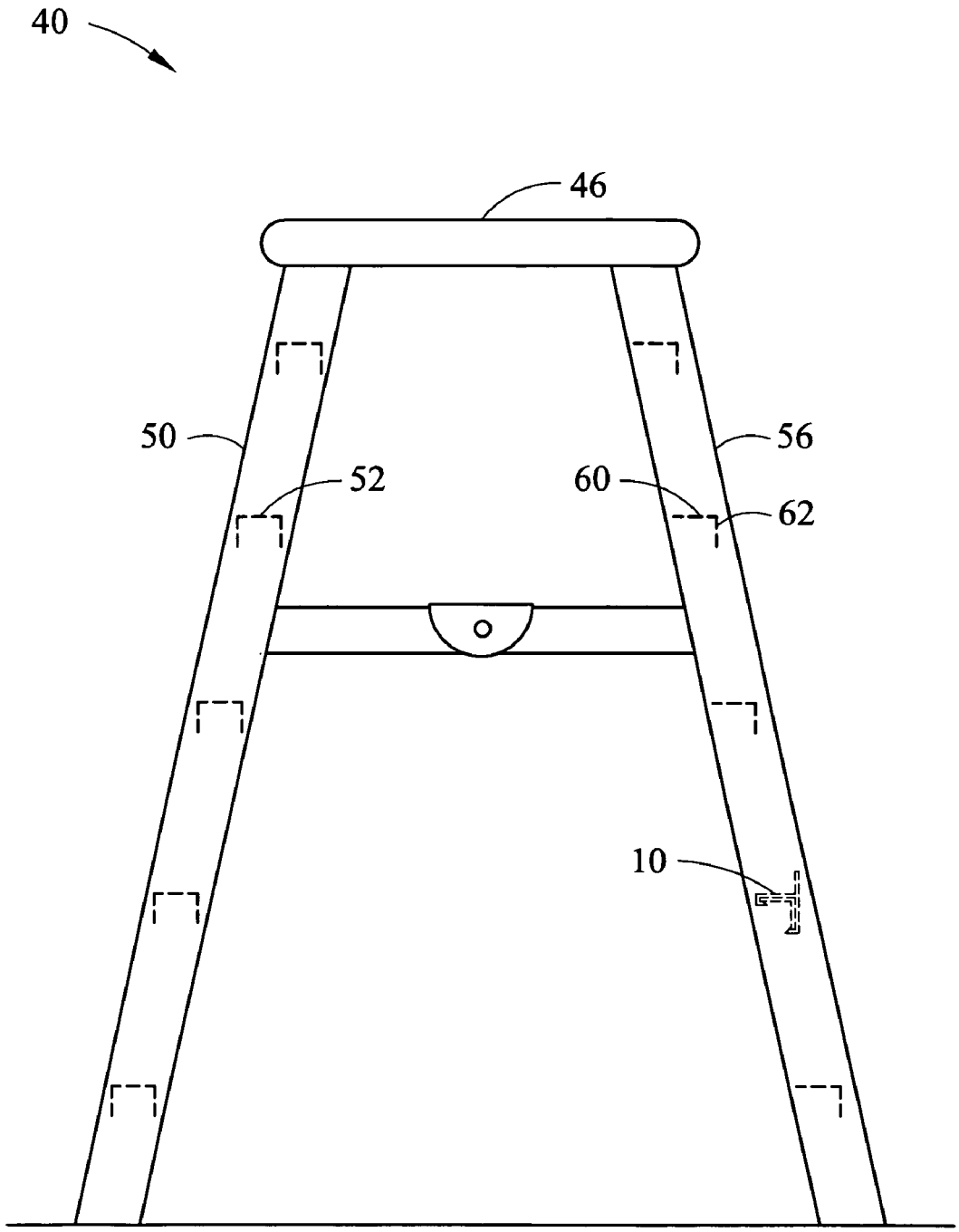
FIG. 8 is a side view of the ladder of FIG. 7 according to various embodiments.

FIGS. 7 and 8 illustrate various embodiments of a ladder 40 having the pipe holder 10 connected thereto. The ladder 40 includes a front section 42, a rear section 44 and a top section 46 connected to the front and rear sections 42, 44. The top section 46 is fixedly connected to one of the front and rear sections 42, 44 and pivotably connected to the other of the front and rear sections 42, 44. The front section 42 includes a first side rail 48, a second side rail 50 opposite the first side rail 48, and a plurality of steps 52 connected to the first and second side rails 48, 50. The rear section 44 includes a third side rail 54, a fourth side rail 56 opposite the third side rail 54, a plurality of crossmembers 58 connected to the third and fourth side rails 54, 56 and the pipe holder 10 connected to one of the plurality of crossmembers 58. As shown in FIG. 8, each crossmember 58 is an L-shaped crossmember 58 having a base section 60 and a leg section 62 connected to and extending away from the base section 60 perpendicular to the base section 60. The crossmembers 58 are oriented such that each base section 60 is aligned with a corresponding step 52 of the front section 42 of the ladder 40.

According to various embodiments, the pipe holder 10 is removably connected to the crossmember 58. In one aspect of such embodiments, the pipe holder 10 is removably connected to the crossmember 58 with the first set screw 24 threadedly engaged in the second opening 20 and in contact with the leg section 62 of the crossmember 58 and the second set screw 32 threadedly engaged in the third opening 28 and in contact with the base section 60 of the crossmember 58. The first set screw 24 serves to minimize vertical movement of the pipe holder 10 along the leg section 62 and the second set screw 32 serves to minimize lateral movement of the pipe holder 10 along the base section 60. In another aspect, the pipe holder 10 is removably connected to the crossmember 58 with the hook portion 34 of the body member 12 hooked around the leg section 62 of the crossmember 58 and the second set screw 32 threadedly engaged in the third opening 28 and in contact with the base section 60 of the crossmember 58. The hook portion 34 of the body member 12 serves to minimize vertical movement of the pipe holder 10 along the leg section 62 and the second set screw 32 serves to minimize lateral movement of the pipe holder 10 along the base section 60. In another aspect, the pipe holder 10 is removably connected to the crossmember 58 with the hook portion 34 of the body member 12 hooked around the leg section 62 of the crossmember 58 and the hook portion 36 of the support member 14 hooked around the base section 60 of the crossmember 58. The hook portion 34 of the body member 12 serves to minimize vertical movement of the pipe holder 10 along the leg section 62 and the hook portion 36 of the support member 14 serves to minimize lateral movement of the pipe holder 10 along the base section 60.

According to other embodiments, the pipe holder 10 is fixedly connected to the crossmember 58 with a fastener such as a rivet. According to other embodiments, the pipe holder 10 is formed integral with the crossmember 58.

Figure 9:
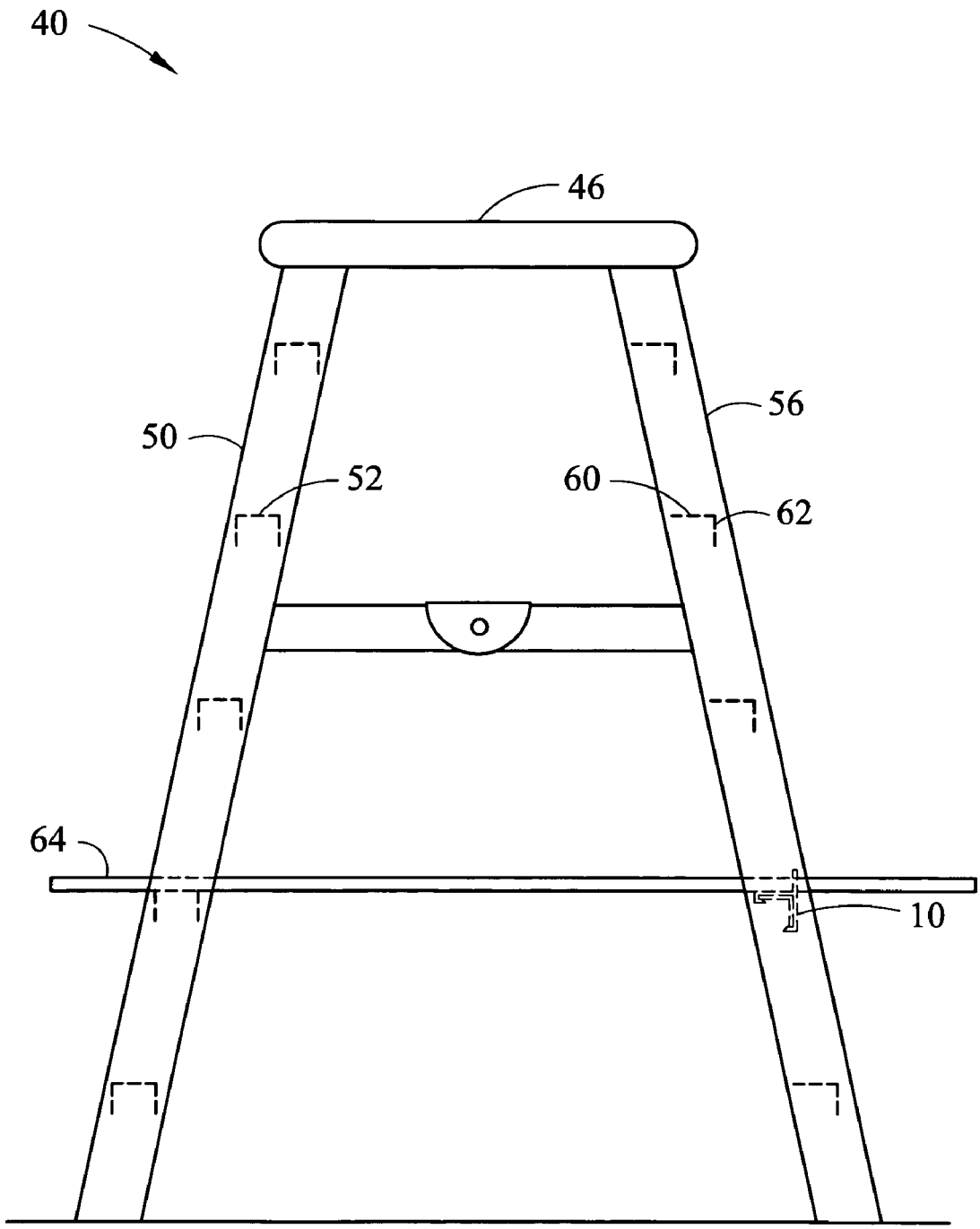
FIG. 9 illustrates the ladder of FIG. 7 being used to support a length of pipe.

FIG. 9 illustrates the ladder 40 being used to support a length of pipe 64 that is to be cut. As shown in FIG. 9, the pipe 64 has been passed between the first and second side rails 48, 50 of the front section 42 of the ladder 40 and through the opening 16 of the pipe holder 10. Thus, the pipe 64 is supported by a step 52 at the front section 42 of the ladder 40 and by the pipe holder 10 at the rear section 44 of the ladder 40. According to various embodiments, the pipe 64 is also supported at the rear section 44 of the ladder 40 by the base section 60 of the crossmember 58. The pipe holder 10 serves to minimize unwanted movement of the pipe 64.

While several embodiments of the disclosed invention have been described, it should be apparent, however, that various modifications, alterations and adaptations to those embodiments may occur to persons skilled in the art with the attainment of some or all of the advantages of the disclosed invention. For example, various embodiments of the pipe holder 10 do not include the second and third openings 20, 28. It is therefore intended to cover all such modifications, alterations and adaptations without departing from the scope and spirit of the disclosed invention as defined by the appended claims.

What is claimed is:

1. A pipe holder, comprising:

a body member having a first end and a second end; and a support member extending away from the body member at a point intermediate of the first end and the second end such that the pipe holder has a generally T-shaped configuration, wherein the body member and the support member are integral with one another, wherein the support member and the first end of the body member include respective means for engaging a structure external to the pipe holder, and wherein the second end of the body member defines an opening for receiving the pipe.

2. The pipe holder of claim 1, wherein the pipe holder is fabricated from a metal.

3. The pipe holder of claim 1, wherein the pipe holder is fabricated from a plastic.

4. The pipe holder of claim 1, wherein the opening is a circular-shaped opening.

5. The pipe holder of claim 1, wherein the body member defines a second opening.

6. The pipe holder of claim 5, wherein the second opening is a threaded opening.

7. The pipe holder of claim 5, wherein the second opening is positioned between the support member and the second end of the body member.

8. The pipe holder of claim 5, wherein the support member defines a third opening.

9. The pipe holder of claim 8, wherein the third opening is a threaded opening.

10. The pipe holder of claim 1, wherein the body member further includes a hook portion proximate the second end of the body member.

11. The pipe holder of claim 1, wherein the support member extends perpendicularly from the body member, and wherein the engages means of the support member and the first end of the body member include respective set screws adapted to engage the external structure.

12. The pipe holder of claim 1, wherein the support member includes a hook portion proximate a second end of the support member.

13. A ladder, comprising:

first and second side rails;

a cross member connected to the first and second side rails; and a pipe holder connected to the crossmember, wherein the pipe holder includes:

a body member having a first end and a second end; and a support member extending approximately perpendicularly from the body member at a point intermediate of the first end and the second end such that the pipe holder has a generally T-shaped configuration, wherein the body member and the support member are integral with one another, wherein the support member and the first end of the body member include respective means for engaging a structure external to the pipe holder, and wherein the second end of the body member defines an opening for receiving the pipe.

14. The ladder of claim 13, wherein the pipe holder is removably connected to the crossmember via the engaging means.

15. The ladder of claim 14, wherein the pipe holder is removably connected to the crossmember with engaging means in the form of a set screw.

16. The ladder of claim 14, wherein the pipe holder is removably connected to the crossmember with engaging means in the form of an elastic hook.

17. The ladder of claim 13, wherein the pipe holder is fixedly connected to the crossmember.

18. The ladder of claim 17, wherein the pipe holder is fixedly connected to the crossmember with a fastener.

19. The ladder of claim 13, wherein the pipe holder is formed integral with the crossmember.

20. A ladder, comprising:

first and second side rails;

a cross member connected to the first and second side rails; and a pipe holder connected to the crossmember, wherein the pipe holder includes:

a body member having a first end and a second end, wherein the body member includes means for allowing a length of pipe to pass therethrough;

a support member extending away from the body member at a point approximately midway between the first end and the second end such that the pipe holder has a generally T-shaped configuration, wherein the body member and the support member are integral with one another, and wherein the support member and the first end of the body member include respective book portions for engaging the crossmember; and wherein the pipe holder is connected to the crossmember so as to dispose the length of pipe perpendicularly to the crossmember.

* * * * *